US009676228B2

(12) United States Patent
Piat et al.

(10) Patent No.: US 9,676,228 B2
(45) Date of Patent: Jun. 13, 2017

(54) DECORATIVE ELEMENT COMPRISING A NUMBER OF STONES WHICH ARE ASSEMBLED WITHIN A CLOSED FRAME, COMPRISING TWO DECORATIVE FACES

(71) Applicant: Van Cleef & Arpels SA, Villars-sur-Glane (CH)

(72) Inventors: Emmanuel Piat, Colombes (FR); Frederic Prybilski, Longjumeau (FR)

(73) Assignee: VAN CLEEF & ARPELS SA, Villars-sur-Glane (CH)

( * ) Notice: Subject to any disclaimer, the term of this patent is extended or adjusted under 35 U.S.C. 154(b) by 0 days.

(21) Appl. No.: 14/764,366

(22) PCT Filed: Jan. 30, 2014

(86) PCT No.: PCT/IB2014/000779

§ 371 (c)(1),
(2) Date: Jul. 29, 2015

(87) PCT Pub. No.: WO2014/118646

PCT Pub. Date: Aug. 7, 2014

(65) Prior Publication Data

US 2015/0367675 A1 Dec. 24, 2015

(30) Foreign Application Priority Data

Jan. 30, 2013 (FR) ..... 13 00197

(51) Int. Cl.

| | |
|---|---|
| ***A44C 17/02*** | (2006.01) |
| ***B44C 3/12*** | (2006.01) |
| ***A44C 17/00*** | (2006.01) |

(52) U.S. Cl.

CPC ..... *B44C 3/12* (2013.01); *A44C 17/002* (2013.01); *A44C 17/025* (2013.01); *Y10T 428/24529* (2015.01)

(58) Field of Classification Search

CPC ..... Y10T 428/161; A44C 17/025; A44C 17/0241; A44C 17/005

See application file for complete search history.

(56) References Cited

U.S. PATENT DOCUMENTS

| | | | |
|---|---|---|---|
| 802,267 | A | 10/1905 | Chaumet |
| 2004/0182110 | A1 | 9/2004 | Giladi |

FOREIGN PATENT DOCUMENTS

| | | | |
|---|---|---|---|
| EP | 0 527 111 | A1 | 2/1993 |
| EP | 2 412 266 | B1 | 7/2010 |

(Continued)

OTHER PUBLICATIONS

International Search Report for PCT/IB2014/000779 dated Sep. 1, 2014.

*Primary Examiner* — Alexander Thomas
(74) *Attorney, Agent, or Firm* — Pearne & Gordon LLP

(57) ABSTRACT

A decorative element including a number of stones (4) assembled in a closed frame (2) to form two decorative faces. The stones include two opposite external faces (10, 12) which are decorative, and internal faces serving as joints (20, 22) between these stones, and as edging (24, 26) with the interior contour of the frame (32). Some of these internal faces (22, 24) have grooves (28) arranged inside the volume of the frame (2) and accepting strips (34) the ends of which cross the contour of this frame at two opposing points in order to be secured. The decorative element is characterized in that the interior contour (32) of the frame (2) has a protruding cross section which fits into corresponding channels made in the internal edging faces (24, 26) of the stones (4). Applicable for example to the creation of jewelry.

20 Claims, 3 Drawing Sheets

(56) References Cited

FOREIGN PATENT DOCUMENTS

| | | | |
|---|---|---|---|
| FR | 764 966 | A | 5/1934 |
| GB | 1 218 540 | A | 1/1971 |

DECORATIVE ELEMENT COMPRISING A NUMBER OF STONES WHICH ARE ASSEMBLED WITHIN A CLOSED FRAME, COMPRISING TWO DECORATIVE FACES

TECHNICAL FIELD OF THE INVENTION

The present invention concerns a decorative element having several stones assembled within a closed frame, said element having two decorative faces showing, one and the other, only the stones, the fastening or mounting means assembling them being totally concealed inside said stones.

TECHNOLOGICAL BACKGROUND OF THE INVENTION

It is known to make decorative elements, such as jewelry, that comprise several precious stones assembled to one another inside a closed frame, said stones thus forming a whole, one of the faces of which being a decorative face. The fastening means for these stones into the frame can in particular be made invisible on the decorative face and thus, except for professionals, such a construction is surprising in that it does not allow to discern which are the means used on such decorative elements for assembling the stones to one another.

In fact, the frame of this type of decorative elements thus generally comprises a rear face having stone fastening means that remain visible. The rear face can therefore not constitute a second decorative face such as is provided by the front face, which in no way shows the fastening means enabling the stones to be assembled.

Patent application US2004/0182110 A1, published on 23 Sep. 2004 in the name of Haim Giladi, describes an embodiment of a decorative element of the aforementioned type, being an example in which the fastening means of the stones extend in the shape of partitions from the edges and from the bottom of the frame. The partitions intersect with one another so as to define elementary frames that each receives one of the stones constituting the decorative element. The central elementary frame is that which is delimited by the greatest surface and it thus holds the largest stone, whilst the peripheral elementary frames receive stones of smaller size.

Patent FR764.966 published on 31 May 1934 in the name of the company Van Cleef & Arpels describes another example of an embodiment of a decorative element, being an example in which the stone fastening means are constituted by rails extending, in parallel to one another, between two opposite sides of the frame. The stone edges are slightly notched so as to form grooves and, thus, the stones can be slid on the rails through the aforementioned grooves. As long as the stones are contiguous, the stone fastening means are thus partly or entirely concealed from view since they are at least partly inside the stones.

This patent provides for the rails to be in the shape of a T or of rods, flat or round. It has thus been possible to make decorative elements in which the transverse section of the rails is in the shape of a T. The two upper wings of each T-shaped rail are each slid into the groove of one stone whilst the core of the T, perpendicular to said wings, consequently extends between two neighboring stones, at the level of the latter's base. In these embodiments, the rails are thus entirely concealed from view as regards the front, or upper, face of the decorative element. However, the rails remain visible from the rear, or lower, face of the decorative element, with the free extremities of the T cores being in fact visible between the stones' bases. The attempt has furthermore been made to achieve decorative elements along the same principle in which the rails are flat or round rods, but such embodiments were immediately abandoned inasmuch as they proved insufficiently resistant from a mechanical point of view. The stones become disunited under the slightest pressure exerted onto them. It will be easily understood that this weakness is due to the fact that the rails are flat or round, that they no longer have cores like the T-shaped rails do and that thus the parts of the rails onto which the stone bases come to rest are no longer present. Now, it is the different bearing of the stone bases on the rails of the T-shaped cores that provide all their strength to the decorative elements built after the year 1934 according to patent FR764966.

GENERAL DESCRIPTION OF THE INVENTION

The present invention thus has notably as its aim to improve the presentation of such decorative elements by proposing a simple and efficient construction for making two decorative faces on a stone assembly, said construction being however such that this time, the various means used for achieving such an assembly are made totally invisible on both faces.

To this effect, it proposes a decorative element comprising several stones assembled in a closed frame to form two decorative faces, the stones having two opposite external faces which are decorative and internal faces serving to join these stones together, or as an edging to join with the frame's interior contour, some of these internal faces having grooves arranged inside the volume of the frame, for receiving bars, the ends of which cross the contour of the frame at two opposing points in order to be secured, wherein said decorative element is characterized in that the interior contour of the frame has a protruding section which fits into corresponding channels made in the internal edging faces of the stones.

Protruding section is understood to mean here a protruding part having at least two resting surfaces, flat or curved, forming between them at their edge an angle whose value is preferably comprised between 80° and 150°.

One advantage of the decorative element according to the invention is that the protrusion formed at the periphery of the closed frame, on the internal face of said frame, by cooperating through penetration with the corresponding channels provided in the internal edging faces of the stones, ensures the stones are much better wedged and, consequently, sufficient resistance to the pressure that could be exerted on the stones, including a pressure exerted at the center of the decorative element.

The grooves of the stones, the channels made in the internal edging faces of said stones and, similarly, the bars as well as the protrusion provided on the inside contour of the frame, are totally concealed by the stones on each of the two opposite faces of the decorative element. The decorative element according to the invention consequently makes it possible to make an object, for example an item of jewelry, comprising two opposite faces in which only the cut stones are visible, thus excluding their fastening means.

The decorative element according to the invention can furthermore comprise one or several of the following characteristics, which can be combined with one another.

In particular, the frame's contour can have a constant cross section, roughly triangular, comprising on the outside a flat face and, on the inside, two faces defining a V-shaped protrusion.

Preferably, each bar has a section that adjusts without any play to the corresponding grooves of the stones that accommodate them.

Bars can be integrated partly in the protruding shape of the interior contour of the frame.

Advantageously, the frame's contour is entirely integrated in the channels of the internal edging faces of the stones.

According to one embodiment, the frame can have a rectangular shape and can receive stones having also a rectangular shape and that are aligned according to rows parallel to the bars.

In particular, the median plane of the frame can comprise curvatures.

The bars will most often, but not necessarily, be placed in parallel to one another. They can thus also converge to intersect virtually at a point situated outside of the frame in the case of stones being assembled of which some would have a trapezoidal or rectangular trapezoidal contour.

If it is necessary, one or several stones are cut in such a way as to present a projection in the shape of a molding.

Advantageously, the bars cross the contour of this frame through an adjusted slit.

The bars can comprise a flat section placed in the median plane of the frame.

The invention also has as its object a decorative assembly such as an item of jewelry having two opposite decoration faces, said assembly being formed by the juxtaposition of different decorative elements having anyone of the preceding characteristics.

BRIEF DESCRIPTION OF THE DRAWINGS

The invention will be better understood and other characteristics and advantages will appear more clearly by reading the following description given by way of example, with reference to the attached drawings in which.

DESCRIPTION OF A PREFERRED EMBODIMENT OF THE INVENTION

Figure 1:
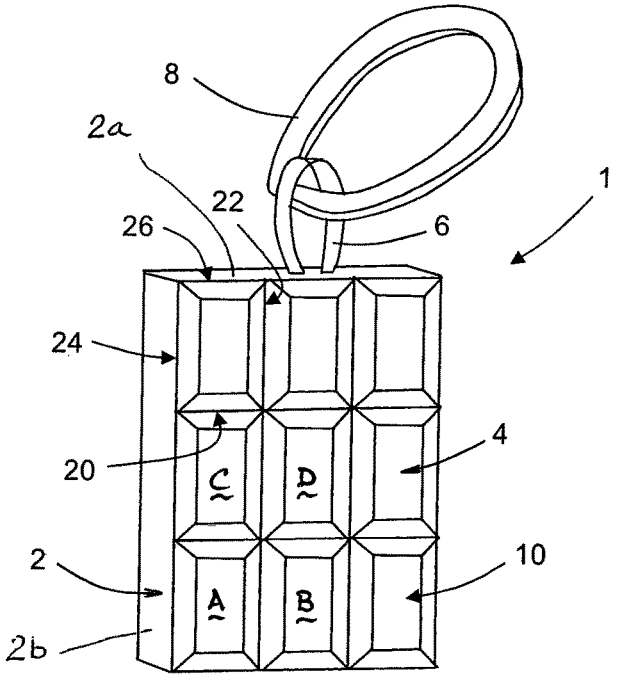
FIG. 1 is a perspective view of a decorative element according to the invention, comprising a frame garnished with cut stones, fastened to a suspension ring.

FIG. 1 presents a decorative element 1 forming for example an item of jewelry, comprising a rectangular closed frame 2 receiving inside three vertical rows that are arranged along a longitudinal direction and which each comprise three cut stones 4. Each stone 4 has two opposite external sides located on the upper side and on the lower side of the frame 2, which are cut to achieve an essentially flat decorative element 1 comprising two decorative faces. The upper face of each of the stones 4 exhibits in the proposed example a so-called facet or facetted cut, but this cut could just as well be buff top or in the form of a cabochon, the choice being dependent on the order given by the recipient of the decorative element and/or dependent on the shape of the stones available to the gem cutter.

The stones 4 are assembled in a jointed fashion and fastened so as to achieve a good mechanical strength of the assembly whilst entirely covering the frame 2 in a front view for each side of the decorative element 1.

A first ring 6 welded onto a small side of the frame 2 receives a fastening ring 8 that, for example, enables a chain to pass through to obtain a pendant.

Each stone 4 comprises, in addition to its two external faces, a rectangular contour that ensures either the junction with other juxtaposed stones or the contact with the edge of the frame 2.

In particular, according to the arrangement in the frame 2, each stone 4 comprises one or two transverse faces 20 serving to join with stones located in the same row, above or below, and one or two longitudinal faces 22 serving to join with stones located at the same height or roughly at the same height in the neighboring rows.

Furthermore, with the exception of the central stone 4 which has only transverse and longitudinal faces that serve to join with neighboring stones, each stone 4 can have either a transverse edging face 26 in contact with the inside of a transverse edge 2*a* of the frame 2, or a longitudinal edging face 24 in contact with the inside of a longitudinal edge 2*b* of this frame, or—as regards the four angle stones—both a transverse edging face 26 and a longitudinal edging face 24.

An assembly is thus made of cut stones 4 that can comprise, for each stone, different shapes, materials, colors or types of cut, as well as if applicable different lengths and/or different heights, wherein said assembly has a decorative surface showcasing these stones and additionally concealing the frame 2 as well as the stone fastening means. In particular, as has been mentioned previously, it is possible to achieve different known types of cut, notably with classic facets, with a single facet, pyramidal, buff top or sugarloaf. These cuts can additionally be made at different heights.

As a variant embodiment, the frame 2 can have a shape different from rectangular, for example hexagonal or even circular, or even constitute a motif representing a heart or a trefoil.

Figure 2:
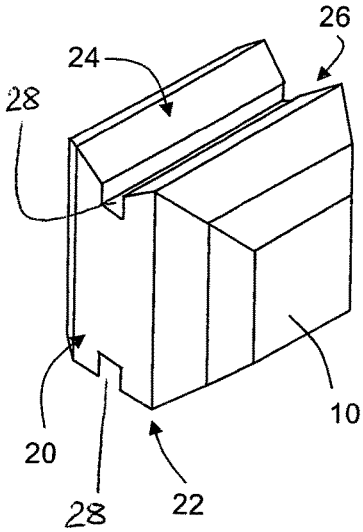
FIGS. 2 to 4 are different views of a single cut stone, intended for being mounted in one angle of the frame.
Figure 3:
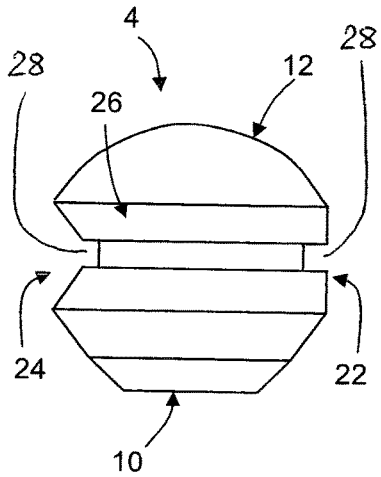
Figure 4:
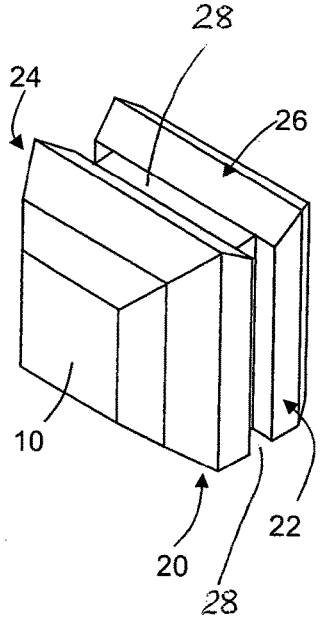
Figure 5:
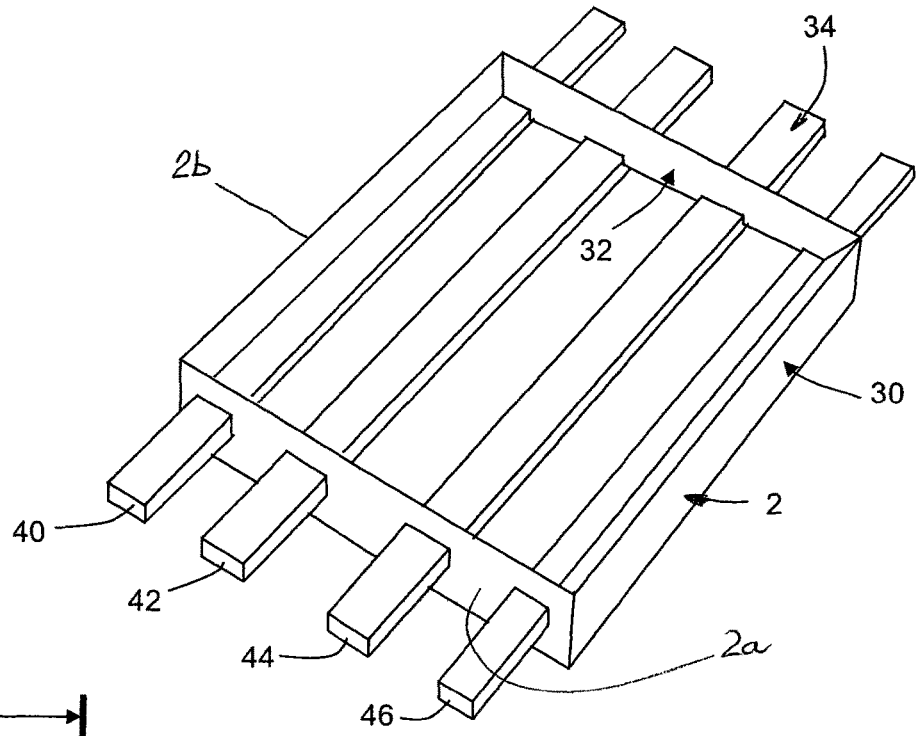
FIG. 5 is a perspective view of the frame comprising only the bars.
Figure 6:
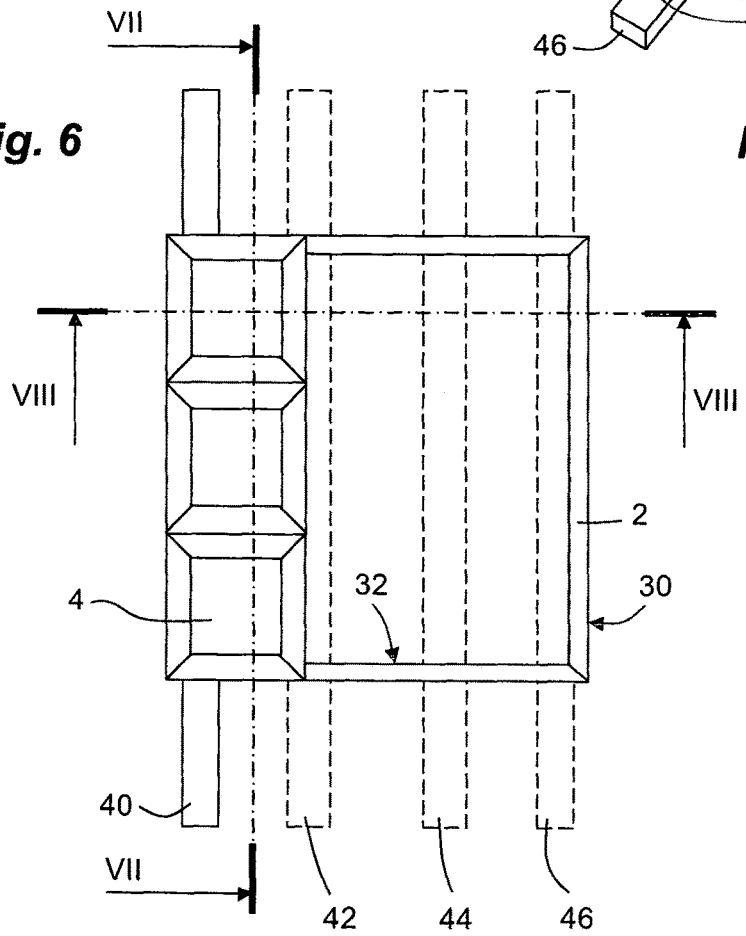
FIGS. 6 to 8 are, respectively: a view from below, a longitudinal cross-section view along the section plane VII-VII and a transverse cross-section view along the section plane VIII-VIII of this decorative element during the course of assembly, having received a row of stones.
Figure 7:
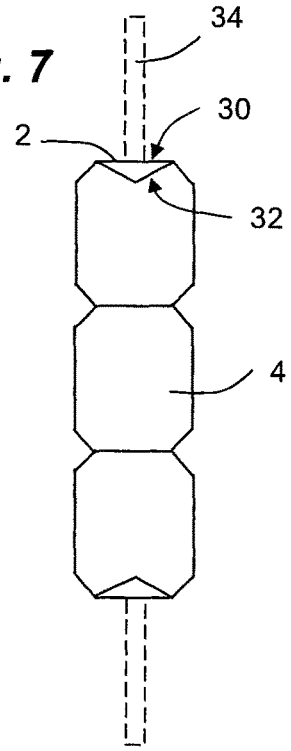
Figure 8:
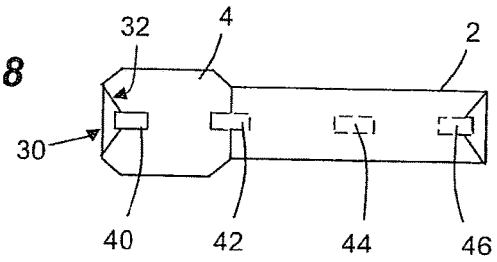

FIGS. 2 to 4 present a stone 4 intended (A) for being mounted in an angle of the frame 2, comprising a facet cut on an external face 10 and a so-called buff top cut on the opposite external face 12.

The angle stone A comprises four different joining or edging faces, namely a transverse joining face 20, that is entirely flat, a longitudinal joining face 22, that is also flat, with a central groove 28 having a rectangular section, a transverse edging face 26 having a beveled channel covering the entire face, and a longitudinal edging face 24 comprising the same beveled channel, with at the bottom a central groove 28 similar to the preceding one. The grooves 28 having a rectangular section are located in the median plane of the frame 2.

Stone B immediately next to the stone A has the same transverse faces 20 and 26 as well as the same longitudinal joining face 22, with its central groove 28, and it is thus different from the angle stone A only through the simple fact that the longitudinal edging face 24 of the latter is replaced by a joining face identical to face 22.

Stone C immediately above the angle stone A has in common with the latter its two longitudinal faces 22 and 24 as well as its transverse joining face 20 and is thus distinguished from said stone A only by its other transverse face, which is also a joining face 20, and not an edging face 26.

Finally, the central stone D has two transverse joining faces identical to 20, entirely flat, and two longitudinal joining faces identical to 22, i.e. flat and provided with a central groove 28.

FIGS. 5 to 8 show the frame 2 having a contour comprising a constant section that is roughly triangular, having on the outside 30 a flat face and on the inside two resting faces 32 that intersect and that thus define with each other a V-shaped protrusion whose central edge is located in the median plane of this frame, said protrusion adjusting perfectly and entirely in the beveled channel of the edging faces 24, 26.

The two resting surfaces 32 are either flat or curved, and in the latter case they can be either convex or concave. The edges of the beveled channel are congruent with the aforementioned resting surfaces, i.e. they are either flat or curved in a concave shape or curved in a convex shape.

Preferably, the angle that the two resting surfaces 32 form with one another at their edge has a value comprised between 80° and 150° and an even more privileged manner it is preferably comprised between 100° and 135° and ideally in the vicinity of 120°.

An angle of less than 80° would require the stones to be cut to have very acute, and thus more fragile, edges.

As a variant embodiment, other forms of cross section for the contour of the frame 2 could be used, provided that there is a corresponding channel cut in the edging faces 24 and 26 of the stones 4.

Four parallel bars 34 having a flat section located in the median plane of the frame 2 are placed along the longitudinal axis of this frame and cross each transverse side through an adjusted slit. Other cross sections for the bars could also be chosen, such as a circular cross section for example.

The four bars 34 are regularly spaced depending on the width of the frame, wherein the two lateral bars 40, 46 reached the longitudinal sides of the frame 2 are each partly integrated in a groove provided in the V-shaped protrusion 32 of these sides.

In one embodiment, if the internal protruding shape 32 of the frame 2 is sufficient for fixedly holding the juxtaposed stones, it is possible not to use the lateral bar 40, 46. Each of the bars 34 has a section that perfectly adjusts, i.e. without any play, in the corresponding grooves 28 of the stones 4 that accommodate said bar.

The bars 34 are prepared with a greater length than that of the frame 2 so as to be easily handled and introduced into the slits of the sides of this frame.

In particular, the frame 2 and the bars 34 can be made of a gold alloy. It is also possible to use other metals and alloys, such as brass or nickel silver.

The assembly of the decorative element occurs as follows.

If it proves necessary, a first lateral bar 40 is placed in position on a longitudinal side of the frame 2 by making it slide into its slits. A first row of stones 4 is installed on this side of the frame 2 by making said stones slide one by one in a horizontal plane so as to adjust the V-shape of the interior contour 32 of this frame in the beveled channels of the edging faces 24, 26. Furthermore, for the longitudinal edging faces 24, the grooves 28 of these faces receive the first lateral bar 40 which adjusts inside it.

The second bar 42 is put in place by making it slide in the following slits of the frame 2 and in the grooves 28 of the longitudinal joining faces 22 of the stones 4 already installed.

The second and third rows of stones 4 start to be installed in the frame 2, by making them slide in a horizontal plane so as to adjust the grooves 28 of the longitudinal edging faces 22 on the second bar 42 and the beveled channels of the edging faces 24, 26 on the V-shaped protrusion 32 of the sides of this frame.

In parallel, the third bar 44 and fourth bar 46 are advanced in the grooves 28 of the longitudinal joining faces 22 and edging faces 24, following the installation of the relevant stones 4, to block them as they are positioned.

A progressive placement of the stones 4 and the bars 34 is thus effected until the positioning of the last stone, which is blocked by the last bar that is put in place in order to ensure a complete hold of the whole ensemble once the assembly has been completed.

It will be noted that the assembly procedure of the stones 4 and of the bars 34 can vary depending on the number of rows and the shape of these stones.

In the end, the extremities of the bars 34 extending beyond the frame 2 are cut, then these bars are welded on this frame in order to ensure they are held definitively. Finishing operations, such as for example polishing the soldering burrs, to obtain smooth and shiny surfaces, can then be carried out.

As the sides of the frame 2 comprise an internal protrusion 32 that is entirely integrated in the channels of the edging faces 24, 26 made on the stones 4, the frame does not appear on the two faces of the decorative element 1. If furthermore the creator of the decorative element, generally a gem cutter, has taken good care to perfectly adjust the transverse joining faces and the longitudinal joining faces of the neighboring stones A, B, C and D, the bars as well will be totally invisible. Thus, only the assembly of the stones 4 on each of the two faces of the decorative element 1 will be seen.

The contour of the stones available to the gem cutter may not always be rectangular. As a variant embodiment, the recipient of the decorative element may wish for the latter to comprise stones whose contour is trapeze-shaped or even having a rectangular trapezoidal contour.

Obviously, in these two exemplary cases, the bars 34 will thus not be parallel to one another but will converge to intersect virtually at a point situated outside the frame.

By the same token, if the decorative element to be made is to represent a motif, for example a trefoil or a heart, or even if it must have a hexagonal, circular or any other complex shape, it is obvious that the bars will not necessarily be parallel to one another. The contour cut of each stone constituting such a decorative element will then be made so that, according to the invention, said stone comprises at least one internal joining face and, if necessary, one or several internal edging faces, all being such that the bars are all entirely concealed by the assembled stones.

Figure 9:
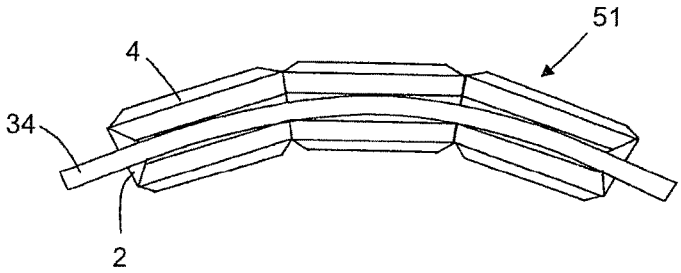
FIG. 9 is a longitudinal cross-section view of a decorative element comprising a curved frame.

FIG. 9 represents a decorative element 51 comprising a frame 2 having a curvature along its longitudinal direction, wherein the bars 34 thus obviously have an identical curvature.

The stones 4 are similar to those presented previously, with however central grooves 28 of the longitudinal joining faces 22 and edging faces 24 that are slightly larger in order to be able to receive in an adjusted manner the bars 34 with their curvature. The channels of the longitudinal edging faces 24 of the stones 4 are also adapted for receiving the internal protrusion 32 of the frame 2 that follows the curvature of this frame.

The assembly of this decorative element 51 proceeds in the same manner, with the curved bars 34 being introduced in the grooves just large enough to ensure the corresponding stones 4 are locked.

It will be noted that the median plane of the frame 2 could comprise a curvature in the transverse direction, or combined curvatures following both directions.

Figure 10:
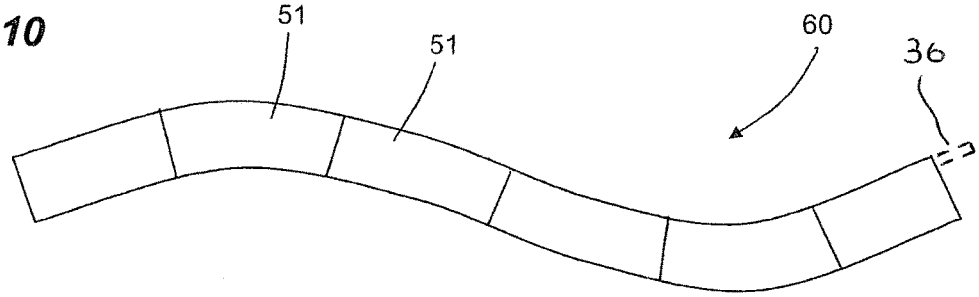
FIG. 10 is a side view of a decorative element comprising an assembly of curved frames.

FIG. 10 shows an assembly 60 of decorative elements 1 and 51, wherein the curved elements 51 can have a concaveness turned in one direction and then in the other, so as to obtain large surfaces covered with stones cut on both faces, without ever letting the frame become apparent.

In the case where the curvatures of such a decorative assembly 60 were to be highly increased, i.e. in the case where the radius were small and there would therefore be a risk of letting a very small part of a bar 34 become visible, it would then advantageously be provided for one of the stones 4 to present, above such a place, a projection 36 in the shape of a molding, such as illustrated in broken line in FIG. 10.

It is notably possible to make, along the same principle, flat or curved surfaces having different contours, with varied colors, to achieve particular decorative forms.

It will incidentally be noted that the execution of the invention has the additional advantage of considerably increasing the number of stones that can be used within the frame of the execution of a decorative element.

Indeed, according to the patent FR764.966 that constitutes the closest prior art document, the use of rails having a T-shaped cross section, i.e. the only cross section for making a decorative element sufficiently resistant to pressure, requires the assembled stones to all be cut so as to have a base with a considerable height in order to make less visible inasmuch as possible the extremities of the cores of the T-shaped rails on which the bases rest.

The fact that, thanks to the invention, the stone fastening means are henceforth free from such cores makes it possible to use flat stones, at least stones considerably less high than previously; the quantity of stones available for making a decorative element is thus increased.

What is claimed is:

1. Decorative element comprising several stones (4) assembled in a closed frame (2) to form two decorative faces, the stones having two opposite external faces (10, 12) which are decorative and internal faces (20, 22) serving to join these stones together, or as an edging (24, 26) to join with the frame's interior contour (32), some of these internal faces (22, 24) having grooves (28) arranged inside the volume of the frame (2), for receiving bars (34), the ends of which cross the contour of the frame at two opposing points in order to be secured, wherein said decorative element is characterized in that the interior contour (32) of each side of the closed frame (2) has a protruding section which fits into corresponding channels made in the internal edging faces (24, 26) of the stones (4).

2. Decorative element according to claim 1, characterized in that the contour of the frame (2) has a constant cross section, roughly triangular, comprising on the outside (30) a flat face and, on the inside, two faces (32) defining a protrusion.

3. Decorative element according to claim 2, characterized in that the two faces (32) defining the protrusion are flat or curved.

4. Decorative element according to claim 2, characterized in that the two faces (32) form with one another at their edge an angle whose value is comprised between 80° and 150°.

5. Decorative element according to claim 2, characterized in that the two faces (32) form with one another at their edge an angle whose value is comprised between 100° and 135°.

6. Decorative element according to claim 2, characterized in that the two faces (32) form with one another at their edge an angle whose value is 120°.

7. Decorative element according to claim 1, characterized in that the contour of the frame (2) is entirely integrated in the channels of the internal edging faces (24, 26) of the stones (4).

8. Decorative element according to claim 1, characterized in that each bar (34) has a cross section that adjusts without any play in the corresponding grooves (28) of the stones (4) that receive said bar.

9. Decorative element according to claim 1, characterized in that the bars (34) are placed in parallel to one another inside the frame (2).

10. Decorative element according to claim 1, characterized in that the bars (34) converge to intersect virtually at a point situated outside the frame (2).

11. Decorative element according to claim 1, characterized in that the bars (34) are partly integrated in the protruding shape of the interior contour (32) of the frame (2).

12. Decorative element according to claim 1, characterized in that the frame (2) has a rectangular shape and receives stones (4) also having a rectangular shape that are aligned along rows parallel to the bars (34).

13. Decorative element according to claim 1, characterized in that the median plane of the frame (2) comprises curvatures.

14. Decorative element according to claim 1, characterized in that at least one of its stones (4) has a projection (36), wherein the projection (36) extends from the stone (4) to cover a section of the bar (34) not within the corresponding groove (28) of the stone (4) with the projection (36) or within the corresponding grooves (28) of adjacent stones (4).

15. Decorative element according to claim 1, characterized in that the bars (34) cross the contour of the frame (2) through an adjusted slit.

16. Decorative element according claim 1, characterized in that the bars (34) comprise a flat section placed in the median plane of the frame (2).

17. Decorative assembly (60) having two opposite decoration faces, characterized in that it comprises different juxtaposed decorative elements (1, 51) made according to claim 1.

18. Decorative element according to claim 1, characterized in that the protruding section of each side is contiguous with the protruding section of any adjacent side to form a continuous protruding section along the entire interior contour (32).

19. Decorative element according to claim 1, characterized in that the frame (2) has a constant cross section.

20. Decorative element comprising several stones (4) assembled in a closed frame (2) to form two decorative faces, the stones having two opposite external faces (10, 12) which are decorative and internal faces (20, 22) serving to join these stones together, or as an edging (24, 26) to join with the frame's interior contour (32), some of these internal faces (22, 24) having grooves (28) arranged inside the volume of the frame (2), for receiving bars (34), the ends of which cross the contour of the frame at two opposing points in order to be secured, wherein said decorative element is characterized in that the interior contour (32) of the frame (2) has a protruding section which fits into corresponding channels made in the internal edging faces (24, 26) of the stones (4) and wherein at least one receiving bar (34) crosses the contour of the frame (2) through an adjusted slit.

* * * * *